US008359731B2

(12) United States Patent
Chiapuzzi

(10) Patent No.: US 8,359,731 B2
(45) Date of Patent: Jan. 29, 2013

(54) TOOL FOR POSITIONING A FIXING ELEMENT

(75) Inventor: Angelo Chiapuzzi, Milan (IT)

(73) Assignee: Atlas Copco BLM S.R.L., Paderno Dugnano, Milan (IT)

( * ) Notice: Subject to any disclaimer, the term of this patent is extended or adjusted under 35 U.S.C. 154(b) by 482 days.

(21) Appl. No.: 12/452,266

(22) PCT Filed: Jun. 12, 2008

(86) PCT No.: PCT/EP2008/004718

§ 371 (c)(1),
(2), (4) Date: Jan. 29, 2010

(87) PCT Pub. No.: WO2009/003574

PCT Pub. Date: Jan. 8, 2009

(65) Prior Publication Data

US 2010/0126004 A1 May 27, 2010

(30) Foreign Application Priority Data

Jun. 29, 2007 (IT) ..... MI2007A1309

(51) Int. Cl.
*B25B 27/14* (2006.01)

(52) U.S. Cl. ..... 29/709; 29/407.09; 29/407.1; 29/714; 29/717; 29/818; 29/270

(58) Field of Classification Search ..... 29/407.08, 29/407.09, 407.1, 707, 708, 709, 714, 715, 29/717, 718, 814, 816, 818, 244, 270
See application file for complete search history.

(56) References Cited

U.S. PATENT DOCUMENTS

| | | | | |
|---|---|---|---|---|
| 5,502,884 | A * | 4/1996 | Ladouceur | 29/407.05 |
| 2002/0007545 | A1 * | 1/2002 | Raccosta et al. | 29/407.1 |
| 2003/0037423 | A1 * | 2/2003 | Siegel | 29/407.01 |

FOREIGN PATENT DOCUMENTS

| | | | |
|---|---|---|---|
| DE | 196 50 925 | A1 | 6/1997 |
| DE | 102 37 776 | A1 | 3/2004 |
| DE | 20 2005 019867 | U1 | 1/2008 |
| WO | WO2008/000477 | A | 1/2008 |

OTHER PUBLICATIONS

PCT Search Report dated Sep. 30, 2008.

* cited by examiner

*Primary Examiner* — Jermie Cozart
(74) *Attorney, Agent, or Firm* — Hedman & Costigan, P.C.; James V. Costigan

(57) ABSTRACT

A manual tool for inserting a clip (10) with elastic coupling in a seat, having a body (23) from which protrudes a pusher (32) for the clip and a sensor (34) for detecting the thrust force of the pusher. An electronic controller (24) receives a force signal from the sensor (34) and emits a signal (25, 26) reporting correct or incorrect insertion depending on the pattern of the force signal detected during the insertion of a clip. A movable gauging element is advanced during the insertion thrust of the clip to detect the correct expansion of the clip at the end of insertion.

12 Claims, 2 Drawing Sheets

TOOL FOR POSITIONING A FIXING ELEMENT

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION (1) Field of the Invention

The present invention relates to a tool for secure positioning of a fixing element with elastic coupling in a hole.

(2) Description of Related Art

In mass industrial production so-called "rapid-assembly" assembly elements are being increasingly used. The aim is to reduce both component costs and the time required for assembly. Further, there are cases where the use of the more traditional threaded connections (bolts, screws, etc) becomes particularly difficult and unsuitable: this is for example the case with the removable joining of two or more thin sheet-metal elements or elements made of plastics.

The car industry in particular, owing to the variety of assembly problems connected with the various vehicle components, for the solution of joining thin sheet-metal parts or parts made of plastics, fixing in position cables, conductors, pipes and anything else has for some time adopted rapid-assembly systems, devising special "fasteners" for all needs.

In general, these rapid-assembly elements are used in non-critical situations (metal panels, parts made of plastics for interiors, etc), and the shape, dimensions, constructional and coupling tolerances determined experimentally permit the use thereof without particular control needs of the assembly result. It is sufficient for the operator to insert, manually or using specific and in general simple tools, these elements into the seats thereof to create a joining of parts that is reliable for the type of use.

However, there are parts, the joining of which requires secure testing of the result: this is for example the case when joining panels that constitute the containers of the airbag systems in motor vehicles.

In general, these panels are fitted with screws: the position thereof, which is at times not very accessible, requires the use of special tools and a relatively long time for screwing and therefore a particularly high processing cost.

Specialized companies in the industry have developed particular fasteners such as rapid-insertion or snap-fixing elements which are proposed for replacing these screws with excellent results, both in terms of stability of the cover panels and in terms of the drastic reduction in assembly time.

As these are connections for which safety must be assured, the automobile manufacturers who intend to adopt these snap-insertion fasteners desire to be sure that the personnel assigned to fitting fit the fastener correctly in the seat provided so that the fastener performs the function for which it has been adopted. With the simple known tools (in general consisting at most of a passive thrust element of the fastener) this assembly safety is never obtained.

The general object of the present invention is to overcome the aforesaid drawbacks by providing a tool for the safe fitting of a snap fixing element to be inserted into a hole in which it is anchored.

BRIEF SUMMARY OF THE INVENTION

In view of this object it has been decided to devise, according to the invention, a manual tool for inserting a clip with elastic coupling in a seat, comprising a body from which protrudes a pusher for the clip and comprising sensor means for detecting the thrust force of the pusher and an electronic controller that receives a force signal from this sensor means and sends a signal reporting correct or incorrect insertion, depending on the pattern of the force signal detected during the insertion of a clip.

BRIEF DESCRIPTION OF THE SEVERAL VIEWS OF THE DRAWINGS

In order to make clearer the explanation of the innovative principles of the present invention and the advantages thereof over the prior art, a possible embodiment applying these principles will be disclosed below with the help of the attached drawings. In the drawings.

DETAILED DESCRIPTION OF THE INVENTION

Figure 1:
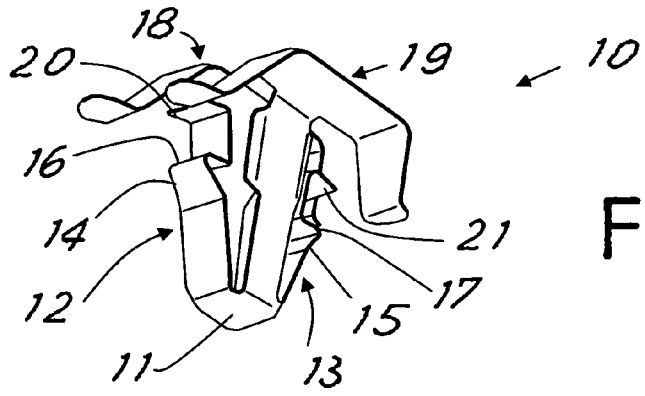
FIG. 1 shows a schematic perspective view of an example of a snap fixing element that is fittable with safety by means of a tool according to the invention.

With reference to the figures, in FIG. 1 there is shown schematically an example of a clip fastener or snap elastic fixing element, indicated generally by 10, usable with the tool according to the invention. The clip 10 is particularly usable by car manufacturers for fixing the panels of airbags. Naturally, the description of the clip given below is not limiting for the tool according to the invention, as will be clear below.

The clip 10 comprises a tip or bottom 11 from which two elastic tabs 12 and 13 protrude as arrows that are shaped with respective cam protrusions 14 and 15, for flexing the fins during introduction into an assembly seat until it snaps into place. After the cam surfaces shaped as arrows, each tab defines a step 16, 17 to immobilize the clip after it has passed through the wall thickness to which it has to be connected.

The clip of the example can be obtained by blanking and forging from a sheet of steel that is provided with suitable elastic features so as to ensure that once the clip has been inserted correctly into the clip seat, the original protrusion of the two tabs 12, 13 returns, thus ensuring stability against re-extraction.

The two fins indicated with 18 and 19 have the function of maintaining an elastic pressure at four points on the surface resting on the assembly wall. These fins or the ends 20, 21 of the elastic tabs, folded outwardly, prevent the clip sinking any further inside the assembly hole.

The shape of the clip can be thoroughly studied and sized to achieve the preset object. For example, it can be inserted into a rectangular hole.

Figure 2:
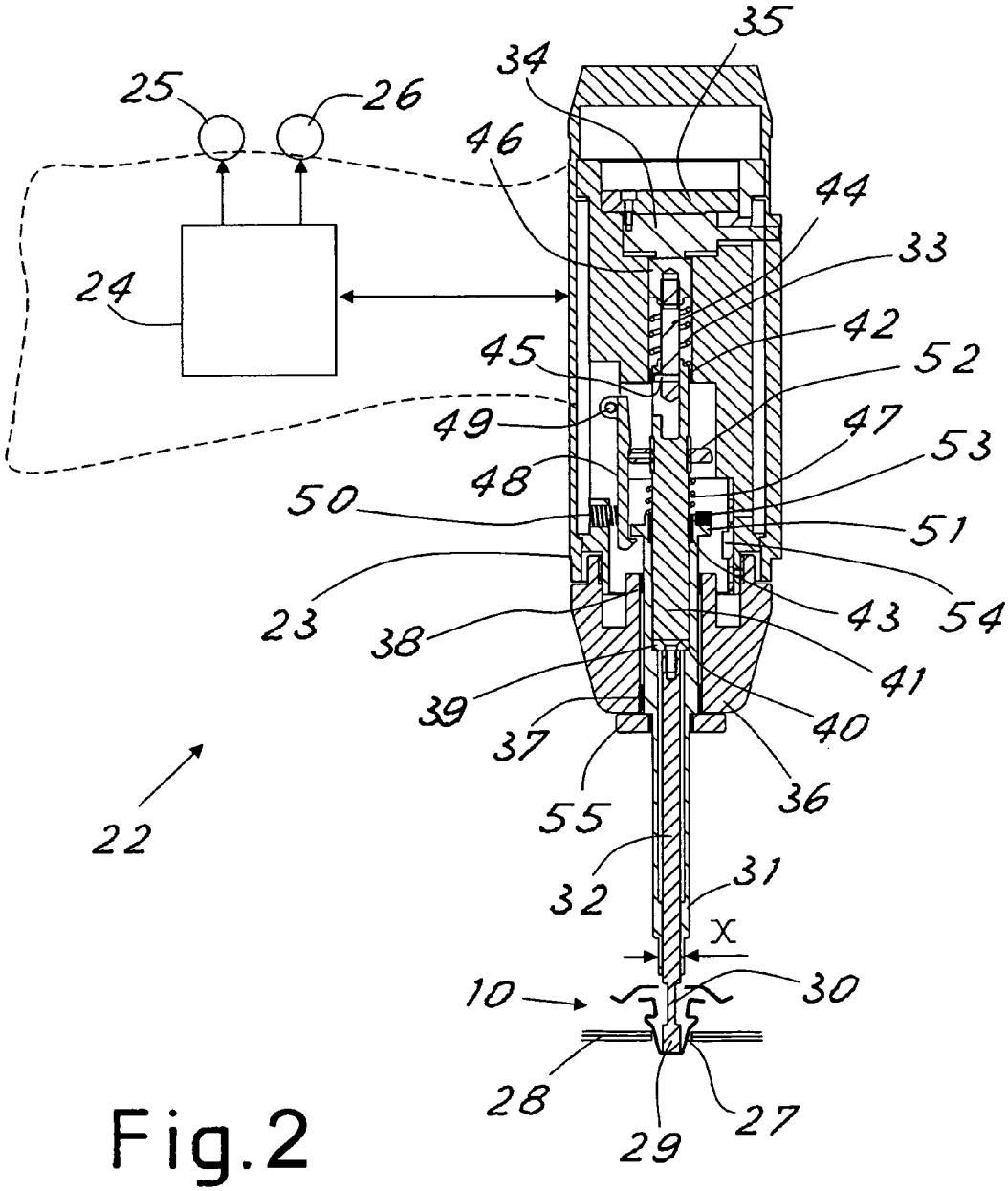
FIG. 2 shows a schematic section view of a tool according to the invention during a first insertion step.

In FIG. 2 there is shown a manual tool, generally indicated by 22, made according to the principles of the present invention to put a clip with elastic coupling in place.

The tool 22, which is advantageously made of molded thermoplastics, generally divided into two half shells and assembled using known methods, for example by means of screws, can have a cylindrical shape or, advantageously, be provided with a pistol grip. The body 23 comprises the mechanical part of the tool, whilst the electronic components (which constitute the control system or electronic controller 24 of the tool) can be contained in the grip, together with the supply batteries, which are not shown. The control system (advantageously a suitably programmed microprocessor control system 24 that is per se known and is easily imaginable by those skilled in the art) commands two warning lights 25, 26 that, as will be seen, indicate the result of the insertion of a clip.

In FIG. 2, the tool is shown in the first step of insertion of a clip 10 through a suitable hole 27 into a panel 28.

The tool has a prod 29 (for example with a rectangular section) by means of which the clip is placed in position. Typically, the prod is dimensioned so as to have an end that is inserted into the clip and rests on the bottom 11. If necessary, an undercut 30 on the prod enables the clip to shrink the fins elastically during insertion.

Advantageously, on the rod of the prod a sleeve or movable element 31 is slidably present, the end dimension of which, indicated by X, is the minimum measurement of the shoulders of the clip (i.e. normally of the free end of two elastic tabs) when, once the clip has been inserted, they tend to return to the initial width position. The movable element slides longitudinally on the prod, during the most suitable insertion moment and checks, as a simple go/not-go gauge, the minimum dimension required after correct insertion of the clip.

The prod 29 is provided with sensor means to measure the axial insertion force of the clip. In the embodiment shown, to obtain this, the prod runs with the rod 32 thereof axially to the inside of the body 23 against the action of a suitable spring 33, thus pushing on sensor means made with a compression load cell 34, advantageously of the strain-gauge type, of suitable capacity and maintained in position by the lid 35.

The front end 36 of the body of the tool, screwed onto the body, advantageously introduces guiding bushes 37, 38 inside, which are preferably made of Teflon, to enable the movable element 31 to slide with low friction that constitutes the go/not-go gauge.

Advantageously, the prod 29 has a rod that has an abutting washer 39 affixed by screw means to make an abutment 40 that determines the protrusion of the prod with respect to the zone that acts as a PN/P gauge.

The washer pushes on a substantially cylindrical element 41, which is in turn guided on bushes 42, 43 that at a front end rests on the washer and on the opposite side runs on a pivot 44 with stroke limit 45 pin.

The pivot 44 is threaded and splined on a cylindrically shaped thrust element 46 the end of which is near the prod of the load cell 34. The compression spring 33 then exerts force, remaining compressed between the element 46 and the element 41, advantageously without imposing a load on the cell but simply by placing the cell alongside with a small space when the tool is at rest. In order to do this, it is possible advantageously to adjust the distance of the element 46 by rotating the element 46 on the threaded pivot 44, so as to adjust the maximum extent of the spring.

The movable gauging element 31 is movable between a non-operating retracted position and an advanced operating position, that takes the calibrated end thereof to the tip of the pusher by movement means that advantageously comprises a spring 47 and a hook 48. In particular, the spring 47 pushes the movable element 31 forward axially. The hook 48, which rotates on a pivot 49 loaded with a spring 50, holds the movable element 31 in a retracted and non-operating position, anchoring on an annular zone 51 thereof.

Figure 3:
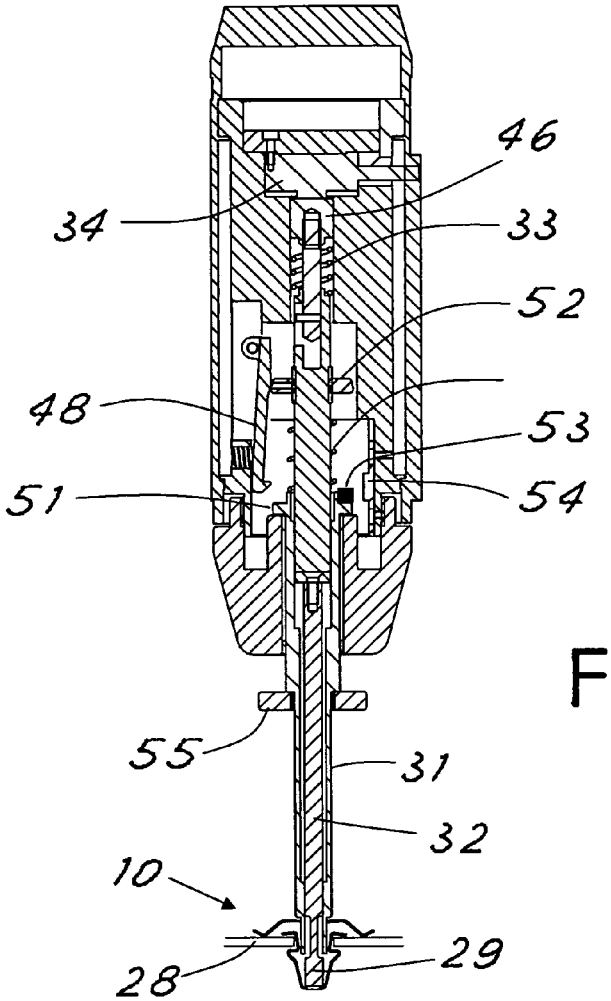
FIG. 3 shows a view of the tool in FIG. 2 during a final insertion step.

The hook 48 frees the movable gauging element 31 when the prod 29 slides sufficiently towards the inside, pushing in turn the cylindrical element 41 and a cam-shaped disc 52 therewith that pushes onto a suitably shaped zone of the hook to rotate the hook against the action of the spring 50. This is shown in FIG. 3.

Advantageously, the disc 52 that makes the cam element is axially adjustable in position along the axis of the pusher inasmuch as it is fitted onto a threaded portion of the cylindrical element 41. A grubscrew enables the disc to be locked in the correct position.

The stroke of the movable element 31 is limited by the stroke-limit abutment of the annular zone 51 thereof. A switch means alerts the control system when the movable element reaches the stroke limit correctly. Advantageously, the switch means is made by means of a magnet 53 that slides frontally to a magnetic switch 54 which, if the stroke is complete, changes status, supplying a suitable signal to the electronic card. This prevents undesired forces opposing sliding. Alternatively, a suitable mechanical contact or other type of known proximity sensor can be used.

Advantageously, the movable element 31 externally has a grasping ring nut 55 that is used to reset the element 31 manually at the end of the insertion operation, recharging the spring 47 and rehooking the element 31 to the hook 48.

At this point the operation of the mechanical system for inserting the clip is clear.

Figure 4:
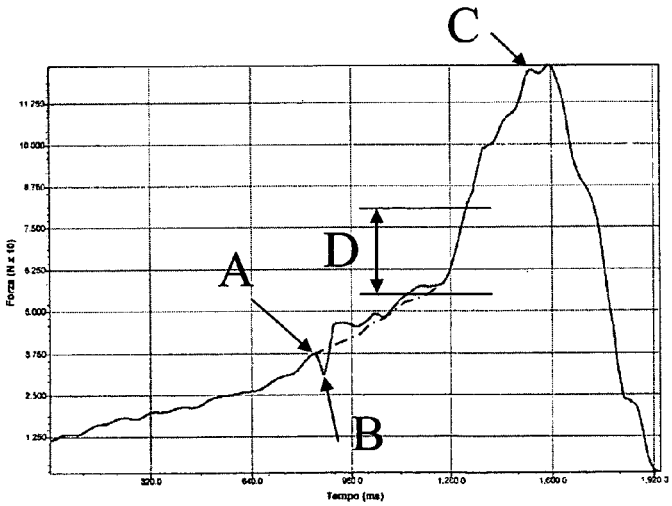
FIG. 4 shows a graph of the action of inserting the tool.

During use of the tool, the clip is positioned on the prod and is pushed therewith into the mounting seat. The force required for inserting the clip is measured by the load cell 34 on the prod of which the element 46 acts, which is in turn pushed by the prod through the element 41 and the spring 33. A typical insertion force pattern is indicated in the diagram in FIG. 4.

As can be seen from the graph, there will be a progressive increase in force whilst the elastic tabs of the clip flex through compression and the clip starts to penetrate into the clip seat. After point 'A' has been passed, the force decreases as the crest of the fins has been passed, which fins snap open again, (point 'B' of the graph), entering the seat. The insertion thrust continues until the set minimum final load is reached (point 'C' of the graph).

For calibrating the tool parameters, the following can be considered:

- point A corresponding to the maximum force measured before the clip is inserted into the clip seat. After suitable practical tests a minimum value can be determined that has to be ascertained to confirm whether both the clip and the corresponding seat have the correct dimensions;
- point B, of insignificant value but lower than A, that has to be present to ensure that, after insertion of the clip in the clip seat, the force release indicates that the fins of the clip have spread out again;
- point C, corresponding to the highest measured force value, the value of which must be higher than a minimum set after appropriate practical tests, and which indicates that the operator continuing the insertion operation has pushed the clip as far as a bottom of the stroke to ensure correct insertion.

During the continuation of the thrust on the prod, in the zone between point B and point C, indicated by D, a further assurance that the clip has been securely and correctly inserted is to measure that the two shoulders between the elastic tabs have returned to the original position, or, at least, to a minimum dimension X, determined experimentally, that confirms the correct positioning (as visible in FIG. 3).

Advantageously, the stroke of the prod, which will increase the load of the spring 33 according to compression thereof, is set so that the cam 52 lifts the hook 48 when the force of the spring reaches a value near or hardly greater than what is on average necessary for the initial insertion of the clip into the seat clip (point A of the graph).

As a result, immediately after the first insertion (point A of the graph) the P/NP gauge 31 is pushed by the spring 47 to the clip to check the distance X of the shoulders if this distance is greater than the set minimum, owing to the thrust of the suitably dimensioned spring 47, the P/NP portion of the gauge can enter the clip, thus actuating the complete stroke of the magnet 53, which will act on the magnetic switch 54, thus indicating a first correct result.

At the same time, after an automatic release of force that follows this first insertion, the prod will continue the stroke and transmit via the measurement on the load cell the information on the continuous measurement of force, until the maximum set value is reached, the minimum acceptable value of which will be determined by experimental tests. If, on the other hand, the shoulders have not returned to the minimum dimension X that indicates that the clip has been inserted correctly, the P/NP gauge will not be able to complete the stroke and the result will thus be an incorrect insertion that the controller will detect due to the failure of the magnetic switch to close.

Once the values A, B and C have been set, and after the gauging element for a particular model of clip and assembly has been unhooked, the controller 24 will be able to check the pattern of the force during each insertion operation, so as to check that there is a fall from point A to point B when a preset force is reached for point A, and will then be able to check that the force increases to a preset value C. Still advantageously, the controller will check by means of the switch means 54 that at the end of the insertion (point C of the curve) the movable gauging element has advanced correctly so that the generation of the correct or incorrect insertion signal is a function of a combination of the pattern of the force signal and of the signal of the advance switch 54. If the insertion operation has thus been concluded with success, the controller will emit the signal that will light up the "insertion correct" warning lamp 25 (advantageously green in color), whereas otherwise the "insertion incorrect" warning lamp 26 will light up (advantageously red in color).

At this point it is clear how the preset objects have been reached. With a tool according to the invention, an operator has only to position a clip and push with appropriate force until the red or green warning light comes on and act accordingly. No other operation and no particular skill are required of the operator to have the certainty of correct positioning of the clips.

Naturally, the above description of an embodiment applying the innovative principles of the present invention is given only by way of example of such innovative principles and must not therefore be taken to limit the protective scope of what is claimed herein.

Accessories to complete the tool can be inserted without thereby changing the function of the tool: for example, there could be wireless transmission of the detected values for a display of values or messages on a suitable display and for storing the measurements and the outcome of the final insertion. There could also be a barcode reader, replaceable prods and/or gauge, for example depending on the specific clip to be fitted, etc. The external body of the tool could be a plastic shell and advantageously contain a structure in aluminum or another alloy with the mechanical pieces. Other structures of the internal mechanisms can be imagined by those skilled in the art, although the structure disclosed has been found to be provided with satisfactory functional features.

The invention claimed is:

1. Manual tool for inserting a clip (10) with elastic coupling into a seat, comprising a body (23) from which protrudes a pusher (32) for the clip (10) and comprising a sensor (34) for detecting the thrust force of the pusher and an electronic controller (24) that receives a force signal from said sensor (34) and sends a signal (25, 26) reporting correct or incorrect insertion, depending on the pattern of the force signal detected during the insertion of a clip wherein axially to the pusher (32) there runs a gauging element (31), that is movable between a non-operating position retracted from the end of the pusher that is pushed on the clip to an operating position advanced to the end of the pusher to be inserted into a suitable space between elastic clips of the clip, wherein said gauging element (31) detects the correct insertion at the end of insertion; a spring and a hook (47, 48) for moving the gauging element (31) from a non-operating position to an operating position in a moment of the operating thrust of the pusher, a switch (54) connected to the electronic controller (24) for detecting when the gauging element (31) has reached a correct insertion position, the electronic controller (24) emitting a correct or an incorrect insertion signal as a function of a combination of a signal indicating the position that has been reached and a pattern of the force signal.

2. Tool according to claim 1, characterized in that the controller identifies in the trend of the force signal a sudden drop in thrust force after a preset first insertion force value (A) has been reached and interprets this as a condition of first insertion of the clip.

3. Tool according to claim 2, characterized in that the controller considers the insertion operation to have terminated and emits said correct or incorrect insertion signal when a preset final insertion force value (C) has been reached that is greater than said first insertion force value (A).

4. Tool according to claim 1, characterized in that the correct/incorrect insertion signal comprises the switching on of a corresponding light signal (25, 26).

5. Tool according to claim 1, characterized in that the pusher (32) is slidable to the inside of the body of the tool against the action of a thrust spring (33) that when compressed pushes against the sensor (34) to detect the thrust force.

6. Tool according to claim 5, characterized in that the maximum extent of the spring (33) is adjustable by a threaded pivot (44) that supports an abutting element (46) between the spring and the sensor.

7. Tool according to claim 1, characterized in that the sensor to detect the thrust force comprises a load-cell sensor (34).

8. Tool according to claim 1, characterized in that the movable gauging element (31) is pushed axially by a spring (47) to the operating position thereof and is retained in a non-operating position by a hook (48) that is unhooked by the command of a movement of the pusher (32) towards an inside part of said tool by a preset amount.

9. Tool according to claim 8, characterized in that the movable element (31) has an external grasping ring nut (55) for resetting the tool by returning the tool manually to the non-operating position.

10. Tool according to claim 8, characterized in that for unhooking, the pusher (32) moves a cam element (52) that slides on a corresponding operating cam surface on the hook (48).

11. Tool according to claim 10, characterized in that the cam element is a disc (52) that is axially adjustable by a screw along the axis of the pusher.

12. Tool according to claim 1, characterized in that the switch comprises a magnetic switch (54) driven by a magnet (53) placed on the movable gauging element (31).

* * * * *